US006386161B2

(12) United States Patent
Pierik

(10) Patent No.: US 6,386,161 B2
(45) Date of Patent: May 14, 2002

(54) CAM LINK VARIABLE VALVE MECHANISM

(75) Inventor: Ronald J. Pierik, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/755,345

(22) Filed: Jan. 5, 2001

Related U.S. Application Data

(60) Provisional application No. 60/175,951, filed on Jan. 13, 2000.

(51) Int. Cl.[7] ..... F01L 13/00

(52) U.S. Cl. ..... 123/90.16; 123/90.17; 123/90.24; 123/90.6

(58) Field of Search ..... 123/90.15, 90.16, 123/90.17, 90.22, 90.24, 90.25, 90.31, 90.39, 90.41, 90.43, 90.45, 90.6

(56) References Cited

U.S. PATENT DOCUMENTS 4,572,118 A * 2/1986 Baguena ..... 123/90.16
5,937,809 A * 8/1999 Pierik et al. ..... 123/90.16
6,019,076 A * 2/2000 Pierik et al. ..... 123/90.16
6,311,659 B1 * 11/2001 Pierik ..... 123/90.24

* cited by examiner

*Primary Examiner*—Weilun Lo
(74) *Attorney, Agent, or Firm*—John VanOphem

(57) ABSTRACT

A variable valve mechanism includes an elongate input shaft having a central axis. An opening cam lobe and a closing cam lobe are disposed upon the input shaft. The opening cam lobe and the closing cam lobe have a predetermined angular relation relative to each other and relative to the central axis. A rocker assembly has a first end and a second end. The rocker assembly carries a roller that engages the opening cam lobe. A first split frame member assembly is pivotally mounted upon the input shaft. The first split frame member assembly is pivotally coupled at a first end thereof to the rocker assembly. The first split frame member assembly is configured for being pivotally coupled at a second end thereof to a control shaft. A first split output cam is pivotally mounted upon the input shaft, and a link pivotally couples the first split output cam to the second end of the rocker assembly.

21 Claims, 5 Drawing Sheets

CAM LINK VARIABLE VALVE MECHANISM

CROSS REFERENCE

This application claims the benefit of U.S Provisional application 60/175,951 filed Jan. 13, 2000.

TECHNICAL FIELD

The present invention relates to variable valve mechanisms of internal combustion engines.

BACKGROUND OF THE INVENTION

Intake valve throttle control systems, in general, control the flow of gas and air into the cylinders of an engine by varying the timing, duration and/or lift (i.e., the valve lift profile) of the intake valve(s) in response to engine operating parameters, such as, for example, engine load, speed and driver input. Intake valve throttle control systems vary the valve lift profile through the use of various mechanical, electro-mechanical and/or electro-hydraulic configurations, generally referred to herein as variable valve mechanisms. Examples of variable valve mechanisms are detailed in commonly-assigned U.S. Pat. No. 5,937,809, the disclosure of which is incorporated herein by reference.

Conventional variable valve mechanisms are associated with the cam or input shaft of an engine. More particularly, conventional variable valve mechanisms typically include components which are mounted onto the input or cam shaft and undergo pivotal or rotational movement relative thereto. The components of a conventional variable valve mechanism are typically slid onto and over the camshaft into a desired position thereon. The components are dimensioned to closely receive the camshaft to thereby enable smooth and reliable pivotal and/or rotational movement relative thereto.

In a multi-cylinder engine, the camshaft extends the entire length of the engine cylinder head and includes at least one cam lobe for each cylinder. The cam lobes are spaced along the length of the camshaft, and transfer rotary motion of the cam or input shaft to a respective variable valve mechanism. The cam lobes are typically formed integrally with the cam shaft, such as by machining. At least a portion of the cam lobes extend outside the diameter of the input or cam shaft. Thus, the components of a conventional variable valve mechanism which are slidingly received over and mounted onto the camshaft can not be slid past the point where the first cam lobe is positioned on the camshaft. The enlarged-diameter cam lobe precludes sliding components beyond the cam lobe. Therefore, in multi-cylinder engines having conventional variable valve mechanisms, the camshaft must be segmented into multiple sections. Each of the multiple sections corresponds to a respective cylinder of the engine.

Segmentation of the camshaft permits components of the variable valve mechanism to be slid into position on either side of the cam lobe. Further, segmentation of the camshaft enables variable valve mechanisms to be installed for each cylinder. However, segmentation of the camshaft increases the number of machining operations required and thus increases machining costs. Further, the segmented camshafts of each cylinder require precise alignment relative to each other. The alignment process is time-consuming, labor intensive and costly.

Conventional variable valve mechanisms typically include many component parts, such as link arms, joints, pins and return springs, and are thus relatively complex mechanically. The many component parts increase the cost of the mechanism and make the mechanism more difficult to assemble and manufacture. The joints and pins of a conventional variable valve mechanism are subject to interfacial frictional forces which negatively impact durability and efficiency. The use of return springs negatively impact the durability and limit the operating range of conventional variable valve mechanisms, thereby limiting the operation of the intake valve throttle control system to a correspondingly-limited range of engine operation.

Therefore, what is needed in the art is a variable valve mechanism having a one-piece, unitary camshaft.

Furthermore, what is needed in the art is a variable valve mechanism having fewer component parts.

Still further, what is needed in the art is a variable valve mechanism with fewer joints and/or pins.

Moreover, what is needed in the art is a variable valve mechanism that eliminates the use of return springs.

SUMMARY OF THE INVENTION

The present invention provides a variable valve mechanism for an internal combustion engine.

The invention comprises, in one form thereof, an elongate input shaft having a central axis. An opening cam lobe and a closing cam lobe are disposed upon the input shaft. The opening cam lobe and the closing cam lobe are in a predetermined angular relationship relative to each other and relative to the central axis. A rocker assembly has a first end and a second end. The rocker assembly carries a roller that engages the opening cam lobe. A first split frame member assembly is pivotally mounted upon the input shaft. The first split frame member assembly is pivotally coupled at a first end thereof to the rocker assembly. The first split frame is configured for being pivotally coupled at a second end thereof to a control shaft. A first split output cam is pivotally mounted upon the input shaft, and a link pivotally couples the first split output cam to the second end of the rocker assembly.

An advantage of the present invention is that the one-piece unitary cam or input shaft eliminates the need to precisely align multiple, segmented camshafts.

Another advantage of the present invention is that it uses fewer component parts relative to a conventional variable valve mechanism, thereby reducing the cost and complexity of the mechanism.

A further advantage of the present invention is that fewer joints/pins are necessary relative to a conventional variable valve mechanism, thereby reducing friction and increasing durability of the mechanism.

A still further advantage of the present invention is that return springs are not required, thereby further increasing the durability of the mechanism and enabling use of the mechanism over a wider range of engine operating conditions.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENTS

Figure 1:
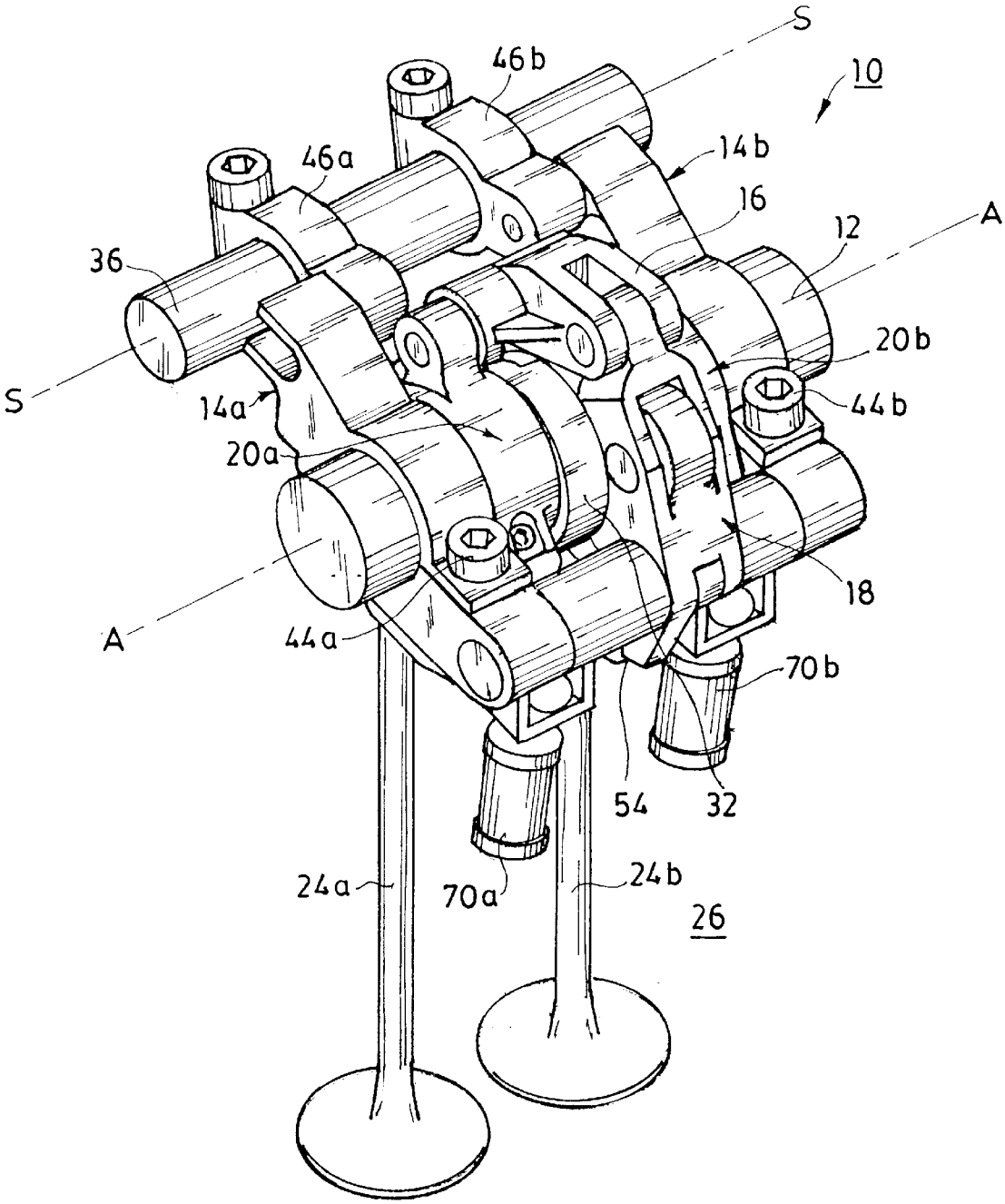
FIG. 1 is an elevated perspective view of one embodiment of a variable valve mechanism of the present invention.
Figure 3:
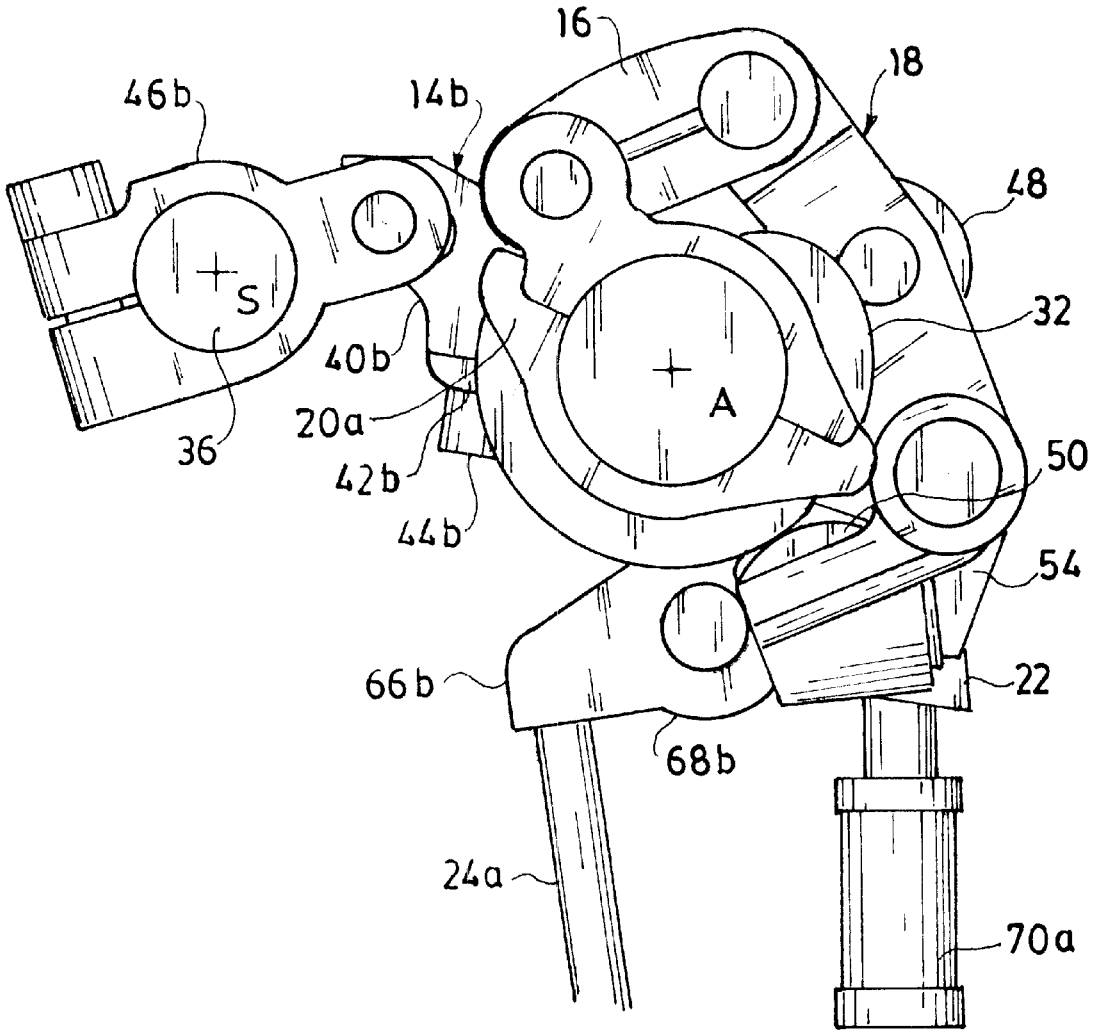
FIG. 3 is a partially-sectioned side of the variable valve mechanism view of FIG. 1.
Figure 4:
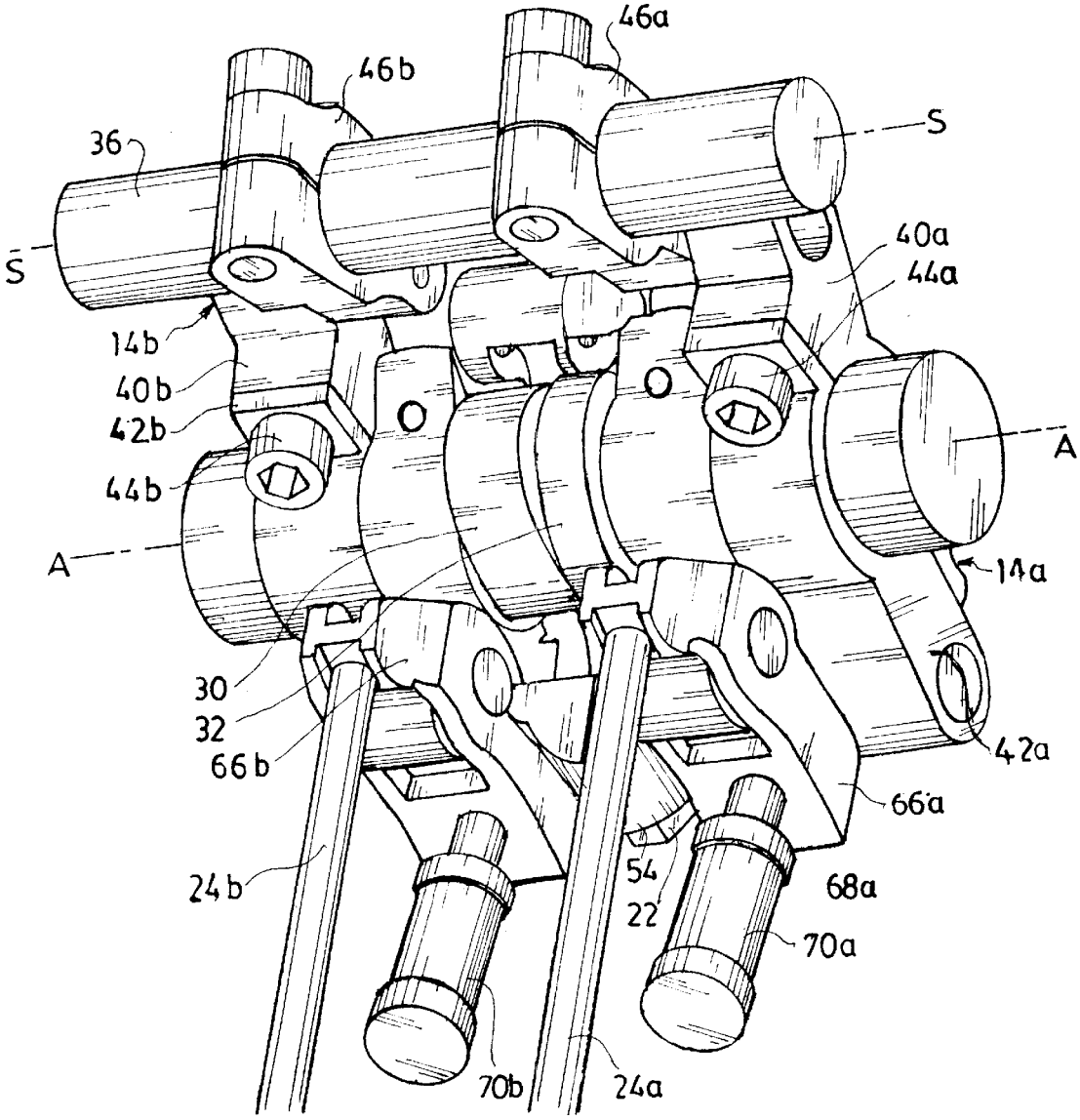
FIG. 4 is a perspective view from below the variable valve mechanism of FIG. 1.

Referring now to the drawings and particularly to FIGS. 1, 3 and 4, there is shown one embodiment of a variable valve mechanism of the present invention. Variable valve mechanism (VVM) 10 includes input shaft 12, split frame member assemblies 14*a* and 14*b*, link 16, rocker assembly 18, split output cams 20*a* and 20*b*, and VVM lash adjuster 22 (FIGS. 3 and 4). As will be described more particularly hereinafter, variable valve mechanism 10 selectively varies the timing, duration and height of the lift of intake valves 24*a* and 24*b* of multi-cylinder internal combustion engine 26.

Figure 2:
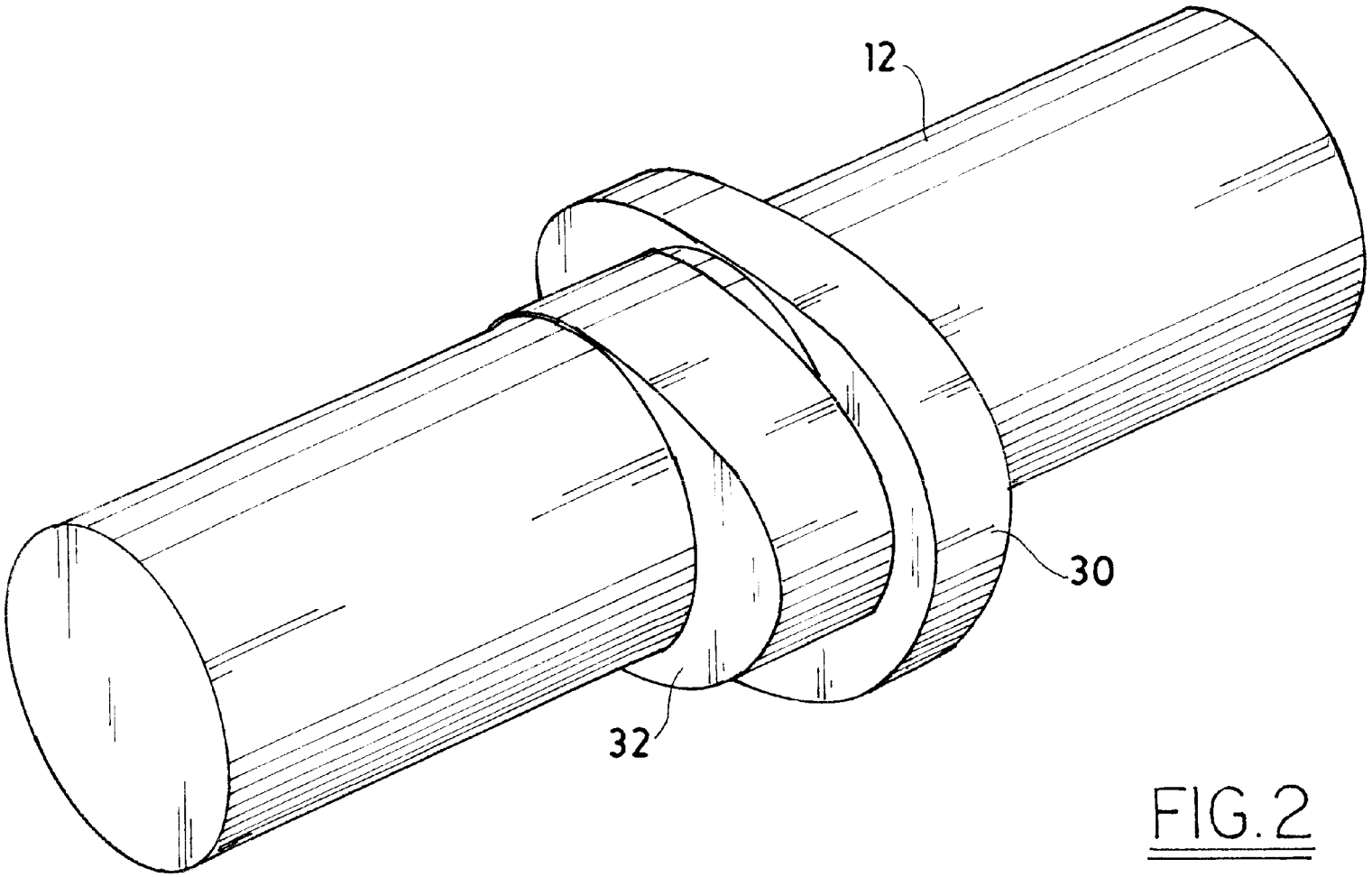
FIG. 2 is a fragmentary, perspective view of the input shaft of FIG. 1.

Input shaft 12, as best shown in FIG. 2, is an elongate shaft member, such as, for example, a camshaft of engine 26. Input shaft 12 has central axis A, and is rotated three-hundred and sixty degrees (360 degrees) around central axis A. Input shaft 12 is driven to rotate in timed relation to the engine crankshaft (not shown), such as, for example, by a camshaft drive, chain, or other suitable means. Input shaft 12 extends the length of the cylinder head (not shown) of engine 26. One or more variable valve mechanisms 10 are associated with each respective cylinder of engine 26. Input shaft 12 includes a plurality of opening cam lobes 30 (only one shown in FIG. 2). Each respective opening cam lobe 30 is paired with a corresponding closing cam lobe 32 (only one shown in FIG. 2).

Opening cam lobe 30 and closing cam lobe 32 are disposed in a predetermined angular relation relative to each other and relative to central axis A. The paired cam lobes 30, 32 (only one pair shown) are spaced along the length of input shaft 12. Each respective pair of cam lobes 30, 32 are associated with a corresponding variable valve mechanism 10 and with a corresponding cylinder of engine 26. For purposes of clarity, a single variable valve mechanism 10 is illustrated in the figures and discussed hereinafter.

Opening cam lobe 30 and output cam lobe 32 rotate as substantially one body with input shaft 12. Opening cam lobe 30 and output cam lobe 32 are, for example, affixed to or integral with input shaft 12. Input shaft 12 is received within and extends through each of split frame member assemblies 14*a*, 14*b* and split output cams 20*a*, 20*b*, as is more particularly described hereinafter.

Split frame member assemblies 14*a*, 14*b* each respectively include top frame sections 40*a*, 40*b* and bottom frame sections 42*a*, 42*b* (FIGS. 3 and 4). Split frame member assemblies 14*a*, 14*b* are pivotally mounted upon input shaft 12 on opposite sides of paired opening cam lobe 30 and closing cam lobe 32. More particularly, each end of top frame sections 40*a*, 40*b* is coupled by fasteners 44*a*, 44*b* (FIGS. 3 and 4), respectively, such as, for example, bolts, screws or other suitable fastening means, to a corresponding bottom frame section 42*a*, 42*b*. Thus coupled together and mounted to input shaft 12, split frame member assemblies 14*a*, 14*b* are not pivoted or rotated by the rotation of input shaft 12. Rather, input shaft 12 is free to rotate about central axis A and relative to split frame member assemblies 14*a*, 14*b*, and split frame member assemblies 14*a*, 14*b* are free to pivot relative to input shaft 12 and relative to central axis A. Split frame member assemblies 14*a*, 14*b* are each pivotally coupled at a respective first end (not referenced) to control shaft 36 and at a respective second end (not referenced) to rocker assembly 18. More particularly, bottom frame sections 42*a*, 42*b* of split frame member assemblies 14*a* and 14*b*, respectively, are pivotally coupled to rocker arm assembly 18. Top frame sections 40*a*, 40*b* of split frame member assemblies 14*a*, 14*b*, respectively, are pivotally coupled by shaft coupling means 46, such as, for example, a control shaft clamp or other suitable coupling means, to control shaft 36.

Link 16 is an elongate arm member that is pivotally coupled at one end to each of split output cams 20*a*, 20*b*, and at the other end is pivotally coupled to rocker assembly 18.

Rocker assembly 18 is coupled, such as, for example, by pins, at a first end (not referenced) to link 16 and at a second end (not referenced) to each of split frame member assemblies 14*a*, 14*b*. Roller 48 (FIG. 3) is carried by rocker assembly 18. Roller 48 engages opening cam lobe 30. Rocker arm assembly 18 includes slider pad 50 (FIG. 3), which engages closing cam lobe 32. Rocker arm assembly 18 further includes finger 54, which extends from the end of rocker arm assembly 18 that is pivotally coupled to split frame member assemblies 14*a*, 14*b*. Finger 54 is disposed in engagement with VVM lash adjuster 22.

Figure 5:
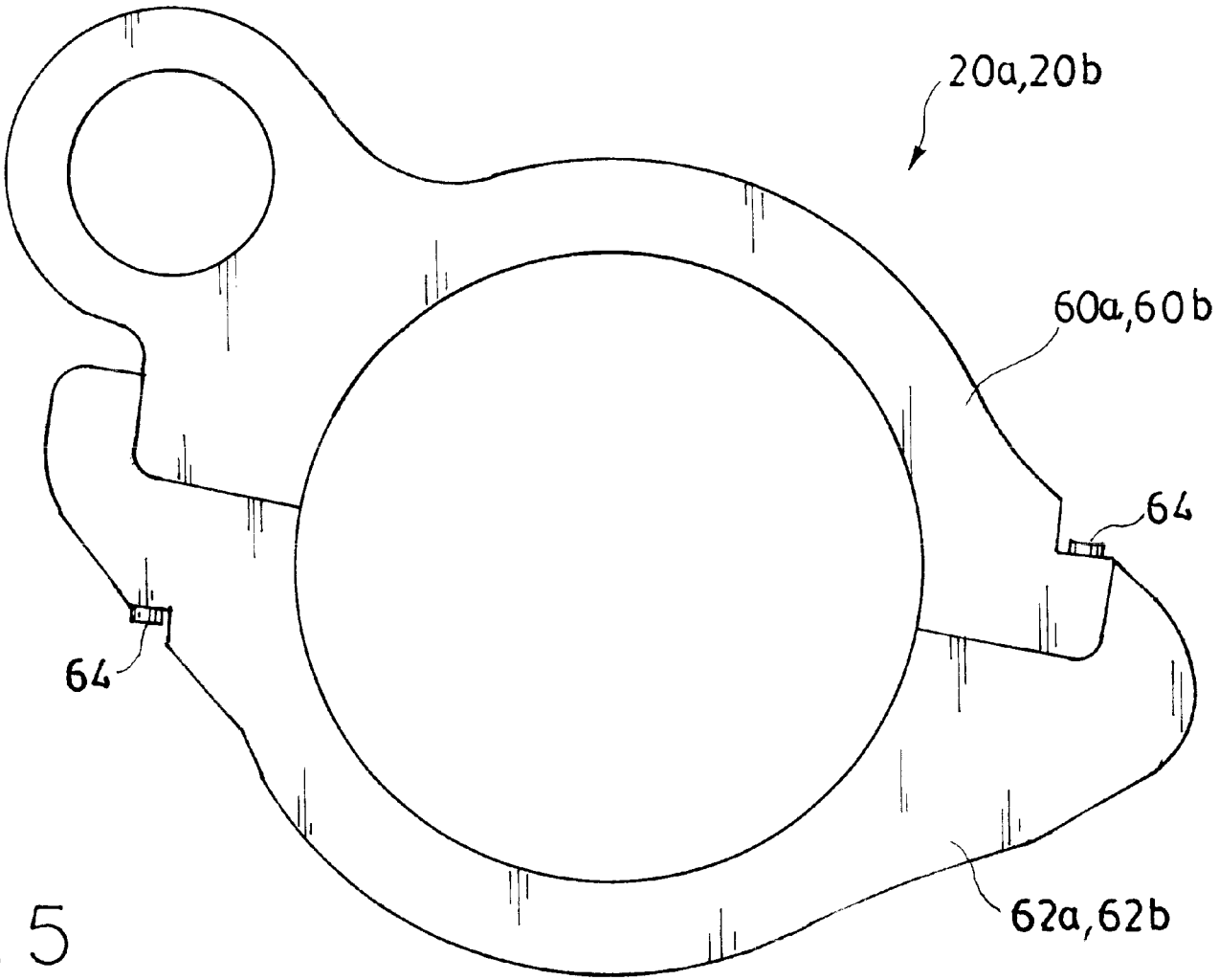
FIG. 5 is a side view of the split output cam of the variable valve mechanism of FIG. 1.

Split output cams 20*a* and 20*b* are substantially identical to each other. As best shown in FIG. 5, split output cams 20*a* and 20*b* each respectively include top portions 60*a*, 60*b* and bottom portions 62*a*, 62*b*. Split output cams 20*a* and 20*b* are each pivotally mounted upon input shaft 12 on opposite sides of paired opening cam lobe 30 and closing cam lobe 32, intermediate the cam lobes 30, 32 and split frame member assemblies 14*a*, 14*b*, respectively. More particularly, a respective top section 60*a*, 60*b* is coupled by fasteners 64, such as, for example, bolts, screws or other suitable fastening means, to a corresponding bottom section 62*a*, 62*b*. Thus coupled together and mounted to input shaft 12, split output cams 20*a* and 20*b* are not pivoted or rotated by the rotation of input shaft 12. Rather, input shaft 12 is free to rotate about central axis A and relative to split output cams 20*a* and 20*b*, and split output cams 20*a* and 20*b* are free to pivot relative to input shaft 12 and relative to central axis A. Each top section 60*a*, 60*b* is pivotally coupled to the end of link 16 opposite the end thereof which is coupled to rocker assembly 18.

VVM Lash adjuster 22 (FIGS. 3 and 4) is disposed between and coupled to roller finger followers (RFF) 66*a*, 66*b* (FIGS. 3 and 4). Each RFF 66*a*, 66*b* includes and carries a respective RFF roller 68*a*, 68*b*. Each RFF roller 68*a*, 68*b* engages a corresponding split output cam 20*a*, 20*b*, respectively. A first end (not referenced) of each RFF 66*a*, 66*b* engages a respective RFF lash adjuster 70*a*, 70*b*, while a second end (not referenced) of each RFF 66*a*, 66*b* engages a respective valve 24*a*, 24*b*. VVM lash adjuster 22 is configured as, for example, a hydraulic lash adjuster, and includes a piston (not referenced) which engages finger 54 of rocker assembly 18. VVM lash adjuster is operable to extend and retract the piston to act upon finger 54, and thus rocker assembly 18, to maintain slider pad 50 in contact with closing cam 32.

In use, input shaft 12 is rotated three-hundred-sixty degrees (360 degrees) in timed relation to the engine crankshaft (not shown), such as, for example, by a camshaft drive, chain, or other suitable means. Rotation of input shaft 12 results in the rotation of opening cam lobe 30 and closing cam lobe 32, each of which is integral with or affixed to input shaft 12. The predetermined angular relationship of opening cam lobe 30 and closing cam lobe 32 relative to each other and relative to central axis A results in rocker arm assembly 18 being alternately displaced toward and away from central axis A during the rotation of input shaft 12. More particularly, rocker arm assembly is displaced in a generally radial direction away from central axis A during a first portion of the rotation of input shaft 12, thereby actuating valves 24*a*, 24*b*. Displacement of rocker arm assembly 18 in a generally-radial direction inward toward central axis A occurs during a second portion of the rotation of input shaft 12, thus ensuring roller 48 of rocker assembly 18 maintains contact with opening cam lobe 30 and reducing mechanical lash within VVM 10. Further, the displacement of rocker arm assembly inward toward input shaft 12 facilitates closing of valves 24*a*, 24*b* by returning rocker assembly 18 and thus split output cams 20*a*, 20*b* to a low or zero lift position.

The predetermined angular relationship of opening cam lobe 30 and closing cam lobe 32 relative to each other and relative to central axis A is such that as input shaft 12 rotates through a first angular range the low or zero lift portion of the profile of closing cam lobe 32 engages slider pad 50 while the lift portion of the profile of opening cam lobe 30 simultaneously engages roller 48 of rocker assembly 18. The engagement of roller 48 by the lift portion of the profile of opening cam lobe 30 displaces or pushes rocker assembly 18 in a generally-radial direction away from central axis A. As input shaft 12 rotates from the first angular range into and through a second angular range, the lift portion of the profile of closing cam lobe 32 engages slider pad 50 while the zero or low lift portion of the profile of opening cam lobe 30 engages roller 48 of rocker assembly 18. The engagement of slider pad 50 by the lift portion of the profile of closing cam lobe 32 displaces rocker assembly 18 in a generally-radial direction inward toward central axis A. Thus, rocker assembly 18 is oscillated in a generally-radial direction toward and away from central axis A by the rotation of input shaft 12.

Rocker assembly 18 is pivotally coupled to link 16. Thus, the oscillation of rocker assembly 18 toward and away from central axis A is transferred via the pivotal coupling to pivotal oscillation of link 16 relative to central axis A. More particularly, as rocker assembly 18 is displaced outward and away from central axis A link 16 pivots in a clockwise direction about central axis A. As rocker assembly 18 moves inward toward central axis A, link 16 pivots in a counter-clockwise direction relative to central axis A. Thus, link 16 is pivotally oscillated relative to central axis A by the rotation of input shaft 12.

Link 16 is pivotally coupled to each of split output cams 20*a*, 20*b*. Thus, the pivotal oscillation of link 16 relative to central axis A is transferred via the pivotal coupling to oscillatory pivoting of split output cams 20*a*, 20*b* about central axis A. The angular range through which output cams 20*a*, 20*b* pivot is fixed by the displacement of rocker assembly 18 which, in turn, is determined by the lift profile of opening cam lobe 30. Thus, output cams 20*a*, 20*b* pivot through a fixed, predetermined angular range, such as, for example, forty-five degrees, relative to central axis A. Split output cams 20*a*, 20*b* engage RFF rollers 68*a*, 68*b*, respectively, thereby actuating valves 24*a*, 24*b*, respectively.

The angular position of split output cams 20*a*, 20*b* relative to central axis A determines the portion of the lift profiles of split output cams 20*a*, 20*b* which engage RFF rollers 68*a*, 68*b* during pivotal movement of split output cams 20*a*, 20*b*. The portion of the lift profiles of split output cams 20*a*, 20*b* which engage RFF rollers 68*a*, 68*b* determine the valve lift profile of valves 24*a*, 24*b*. Thus, the valve lift profile of valves 24*a*, 24*b* is manipulated by pivoting split output cams 20*a*, 20*b* relative to central axis A. The angular position of split output cams 20*a*, 20*b* relative to central axis A is established by the angular position of control shaft 36 relative to central axis S thereof.

Control shaft 36 is pivoted about central axis S by, for example, an actuator, motor or other suitable means. Control shaft 36 is pivotally coupled to frame members 14*a*, 14*b*. Pivotal motion of control shaft 36 is transferred via pivotal couplings 46*a*, 46*b* to pivotal movement of split frame member assemblies 14*a*, 14*b*, respectively, relative to central axis A. Split frame member assemblies 14*a*, 14*b* are pivotally coupled to rocker assembly 18, and thus pivotal motion of split frame member assemblies 14*a*, 14*b* is transferred via the pivotal coupling to rocker assembly 18. Rocker assembly 18 is pivotally coupled to link 16 which, in turn, is pivotally coupled to each of split output cams 20*a*, 20*b*. Pivotal movement of rocker arm assembly 18 is transferred via link 16 to pivotal movement of split output cams 20*a*, 20*b* relative to central axis A. Thus, the angular position of control shaft 36 relative to central axis A determines the angular position of split output cams 20*a*, 20*b* relative to central axis A. As stated above, the angular position of split output cams 20*a*, 20*b* relative to central axis A determines the portion of the lift profiles thereof which engage RFF rollers 68*a*, 68*b* during oscillatory pivotal movement of split output cams 20*a*, 20*b*, and thereby determines the lift profile of valves 24*a*, 24*b*. Therefore, a desired valve lift profile is selected by placing control shaft 36 in a predetermined angular position relative to central axis S.

In order to achieve a relatively large amount of valve lift, the angular position of split output cam lobes 20*a*, 20*b* relative to central axis A is established, as described above, to position the high lift portions of split output cam lobes 20*a*, 20*b* in relatively close angular proximity to RFF rollers 68*a*, 68*b*. Thus, as split output cam lobes 20*a*, 20*b* pivotally oscillate through the predetermined angular range of motion, the high lift portions of the profile of split output cams 20*a*, 20*b* engage RFF rollers 68*a*, 68*b* and lift valves 24*a*, 24*b* a correspondingly high amount. For example, to achieve a high valve lift in a VVM having split output cam lobes with a pivotal oscillation of forty-five degrees, the split output cam lobes are angularly positioned relative to the central axis to thereby place the high lift portion of the split output cam lobes within forty-five degrees of the associated RFF rollers.

Conversely, in order to achieve a relatively small or zero amount of valve lift, split output cam lobes 20*a*, 20*b* are placed into a predetermined angular position relative to central axis A wherein only the low or zero lift portion of the profile of split output cam lobes 20*a*, 20*b* engage RFF rollers 68*a*, 68*b* during the predetermined angular range of oscillatory pivotal movement; the higher lift portions of the profiles of split output cam lobes 20*a*, 20*b* being disposed outside of the predetermined angular range of the oscillatory pivotal movement thereof and thus not engaging RFF rollers 68*a*, 68*b*.

It should be particularly noted that VVM 10 does not require any biasing means, such as, for example, springs, to reduce mechanical lash. Conventional variable valve mechanisms which employ a roller-type follower that engages the an input or opening cam lobe, such as rocker assembly 18 of VVM 10, typically employ one or more return springs to maintain the roller in contact with the opening cam lobe and to reduce mechanical lash as the opening cam lobe rotates from a high lift position toward a low lift position. In contrast, VVM 10 incorporates closing cam lobe 32 which engages slider pad 50 and acts on rocker assembly 18 to thereby maintain roller 48 in contact with opening cam lobe 30. The use of return springs negatively impact the durability and limit the operating range of conventional variable valve mechanisms. By eliminating return springs, VVM 10 is operable over a broader range of engine operating speeds.

It should be further particularly noted that VVM 10 incorporates lash adjuster 22. Lash adjuster 22 reduces clearances, i.e., lash, between the component parts of VVM 10 due to, for example manufacturing tolerances, temperature variation and mechanical wear, by maintaining sliding pad 58 in contact with closing cam lobe 32. More particularly, VVM lash adjuster 22 is configured as, for example, a hydraulic lash adjuster, and includes a piston (not referenced) which engages finger 54 of rocker assembly 18. VMM lash adjuster is operable to extend and retract the piston to act upon finger 54, and thus rocker assembly 18, to maintain slider pad 50 in contact with closing cam 32.

It should be moreover particularly noted that assembly of a plurality of VVMs 10 onto a single, unitary input shaft is facilitated by split output cams 20*a,* 20*b* and split frame member assemblies 14*a,* 14*b*. Split output cams 20*a,* 20*b* and split frame member assemblies 14*a,* 14*b* are not slid onto and over input shaft 12 in order to be mounted thereon. Rather, top sections 60*a,* 60*b* and bottom sections 62*a,* 62*b* are fastened together to form split output cams 20*a,* 20*b,* and thus split output cams 20*a,* 20*b* can be positioned anywhere along the length of input shaft 12. Similarly, top frame sections 40*a,* 40*b* and bottom frame sections 42*a,* 42*b* are fastened together to form split frame member assemblies 14*a,* 14*b,* and thus split frame member assemblies 14*a,* 14*b* can be positioned anywhere along the length of input shaft 12.

In the embodiment shown, VVM lash adjuster 22 is configured as, for example, a hydraulic lash adjuster. However, it is to be understood that VVM lash adjuster may be alternately configured, such as, for example, a mechanical lash adjuster, adjustment shim or the like.

In the embodiment shown, split output cams 20*a,* 20*b* are substantially identical. However, it is to be understood that the split output cams can be alternately configured, such as, for example, with differing lift profiles, lift ratios, or phased lift profiles. For example, by phasing the lift profiles of split output cams 20*a* and 20*b* VVM 10 can be configured such that split output cams 20*a,* 20*b* actuate an intake valve and an exhaust valve, respectively, of an engine cylinder. As a further example, for an engine having more than one intake valve per cylinder different amounts of valve lift can be achieved for each valve to thereby control the mixture of the combustion charge and/or facilitate swirling of the intake charge.

In the embodiment shown, VVM 10 is configured for use with an engine having two valves 24*a,* 24*b* per cylinder. Thus, VVM 10 includes two split frame member assemblies 14*a,* 14*b* and two split output cams 20*a,* 20*b,* each disposed on a respective side of paired opening cam lobe 30 and closing cam lobe 32 and each actuating a respective valve 24*a,* 24*b*. However, it is to be understood that VVM 10 can be alternately configured, such as, for example, to actuate a single valve by including only one split frames and one split output cam.

In the embodiment shown, closing cam lobe 32 and slider pad 50 act in conjunction to maintain roller 48 of rocker assembly 18 in contact with opening cam lobe 30. However, it is to be understood that VVM 10 can be alternately configured, such as, for example, with a roller or other suitable means that engages closing cam lobe 32 and thereby maintains roller 48 of rocker assembly 18 in contact with opening cam lobe 30.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed:

1. A variable valve mechanism, comprising:

an elongate input shaft having a central axis, an opening cam lobe and a closing cam lobe disposed upon said input shaft, said opening cam lobe and said closing cam lobe having a predetermined angular relation relative to each other and relative to said central axis;

a rocker assembly having a first end and a second end, said rocker assembly carrying a roller, said roller engaging said opening cam lobe;

a first split frame member assembly pivotally mounted upon said input shaft, said first split frame member assembly being pivotally coupled at a first end to said rocker assembly, said first split frame member assembly configured for being pivotally coupled at a second end thereof to a control shaft;

a first split output cam pivotally mounted upon said input shaft; and a link pivotally coupling said first split output cam to said second end of said rocker assembly.

2. The variable valve mechanism of claim 1, wherein said rocker assembly further comprises a slider pad, said slider pad engaging said closing cam lobe.

3. The variable valve mechanism of claim 2, further comprising a lash adjuster engaging said rocker assembly to thereby maintain said slider pad in contact with said closing cam lobe.

4. The variable valve mechanism of claim 3, wherein said lash adjuster is one of a hydraulic lash adjuster and a mechanical lash adjuster.

5. The variable valve mechanism of claim 1, wherein said first split frame member assembly comprises a top frame section and a bottom frame section, said top frame section and said bottom frame section being one of attached and connected to each other.

6. The variable valve mechanism of claim 5, wherein said top frame section and said bottom frame section are attached together by one of bolts and screws.

7. The variable valve mechanism of claim 1, wherein said first split output cam comprises a top cam section and a bottom cam section, said top cam section and said bottom cam section being one of attached and connected to each other.

8. The variable valve mechanism of claim 7, wherein said top cam section and said bottom cam section are attached together by one of bolts and screws.

9. The variable valve mechanism of claim 1, further comprising:

a second split output cam pivotally mounted upon said input shaft, said link pivotally coupling said second split output cam to said second end of said rocker assembly; and a second split frame member assembly pivotally mounted upon said shaft, said second split frame member assembly being pivotally coupled at a first end to said rocker assembly, said second split frame member assembly configured for being pivotally coupled at a second end thereof to a control shaft.

10. The variable valve mechanism of claim 9, wherein:

said first split output cam is disposed adjacent said closing cam lobe;

said second split output cam is disposed adjacent said opening cam lobe;

said first split frame member assembly is disposed adjacent said first split output cam; and said second split frame member assembly is disposed adjacent said second split output cam.

11. The variable valve mechanism of claim 9, further comprising a control shaft, said control shaft being pivotally coupled to said second end of said first split frame member assembly and to said second end of said second split frame member assembly.

12. A variable valve mechanism, comprising:

a unitary elongate input shaft having a plurality of opening cam lobes and a plurality of closing cam lobes, each one of said plurality of opening cam lobes being paired with a corresponding one of said plurality of closing cam lobes;

a plurality of rocker assemblies, each of said plurality of rocker assemblies having a respective first end and a respective second end, each of said plurality of rocker assemblies carrying a respective roller, each respective said roller engaging a corresponding one of said plurality of opening cam lobes;

a plurality of first split frame member assemblies each pivotally mounted upon said input shaft, each of said plurality of first split frame member assemblies being pivotally coupled at a respective first end to a corresponding one of said plurality of rocker assemblies, each of said plurality of first split frame member assemblies configured for being pivotally coupled at a respective second end to a control shaft;

a plurality of first split output cams pivotally mounted upon said input shaft; and a plurality of links pivotally coupling a respective one of said plurality of split output cams to said second end of a corresponding one of said plurality of rocker assemblies.

13. The variable valve mechanism of claim 12, wherein each of said plurality of rocker assemblies further comprises a slider pad, each said slider pad engaging a corresponding one of said plurality of closing cam lobes.

14. The variable valve mechanism of claim 13, further comprising a plurality of lash adjusters, each of said plurality of lash adjusters engaging a corresponding one of said plurality of rocker assemblies to thereby maintain each respective said slider pad in contact with a corresponding one of said plurality of closing cam lobes.

15. The variable valve mechanism of claim 14, wherein each of said plurality of lash adjusters is one of a hydraulic lash adjuster and a mechanical lash adjuster.

16. The variable valve mechanism of claim 12, wherein each of said plurality of first split frame member assemblies comprise a respective top frame section and a corresponding bottom frame section, each respective said top frame section being one of attached and connected to said corresponding bottom frame section.

17. The variable valve mechanism of claim 12, wherein each of said plurality of first split output cams comprise a respective top cam section and a corresponding bottom cam section, each respective said top cam section being one of attached and connected to a said corresponding bottom cam section.

18. The variable valve mechanism of claim 12, further comprising:

a plurality of second split output cams, each of said plurality of second split output cams being pivotally mounted upon said input shaft, a corresponding one of said plurality of links pivotally coupling a respective one of said plurality of second split output cams to a respective said second end of a corresponding one of said plurality of rocker assemblies; and a plurality of second split frame member assemblies each pivotally mounted upon said input shaft, each of said plurality of second split frame member assemblies being pivotally coupled at a respective first end to a corresponding one of said plurality of rocker assemblies, each of said plurality of second split frame member assemblies configured for being pivotally coupled at a respective second end to said control shaft.

19. The variable valve mechanism of claim 18, wherein:

each of said plurality of first split output cams is disposed adjacent a corresponding one of said plurality of closing cam lobes;

each of said plurality of second split output cams is disposed adjacent a corresponding one of said plurality of opening cam lobes;

each of said plurality of first split frame member assemblies is disposed adjacent a corresponding one of said plurality of first split output cams; and each of said plurality of second split frame member assemblies is disposed adjacent a corresponding one of said plurality of second split output cams.

20. The variable valve mechanism of claim 19, wherein said control shaft is pivotally coupled to said second end of each of said plurality of first split frame member assemblies and to said second end of each of said plurality of second split frame member assemblies.

21. An internal combustion engine, comprising:

a variable valve mechanism, said variable valve mechanism including:

an elongate input shaft having a central axis, an opening cam lobe and a closing cam lobe disposed upon said input shaft, said opening cam lobe and said closing cam lobe having a predetermined angular relation relative to each other and relative to said central axis;

a rocker assembly having a first end and a second end, said rocker assembly carrying a roller, said roller engaging said opening cam lobe;

a first split frame member assembly pivotally mounted upon said input shaft, said first split frame member assembly being pivotally coupled at a first end to said rocker assembly, said first split frame member assembly configured for being pivotally coupled at a second end thereof to a control shaft;

a first split output cam pivotally mounted upon said input shaft; and a link pivotally coupling said first split output cam to said second end of said rocker assembly.

* * * * *